US010173821B2

(12) United States Patent
Ma et al.

(10) Patent No.: US 10,173,821 B2
(45) Date of Patent: Jan. 8, 2019

(54) FLEXIBLE FITMENT FOR FLEXIBLE CONTAINER

(71) Applicant: Dow Global Technologies LLC, Midland, MI (US)

(72) Inventors: Liangkai Ma, Midland, MI (US); Sam L. Crabtree, Midland, MI (US); Jorge Caminero Gomes, Sao Paulo (BR); Mark H. Mirgon, Midland, MI (US); Marc S. Black, Midland, MI (US); Mark O. Labonville, Midland, MI (US); Matthew J. Turpin, Midland, MI (US); Matthew J. Heath, Sanford, MI (US); Cory M. Saylor, Sanford, MI (US); Leigh Anne A. VanSumeren, Midland, MI (US); Nicolas Cardoso Mazzola, Jundiai (BR)

(73) Assignee: Dow Global Technologies LLC, Midland, MI (US)

( * ) Notice: Subject to any disclaimer, the term of this patent is extended or adjusted under 35 U.S.C. 154(b) by 50 days.

(21) Appl. No.: 15/275,842

(22) Filed: Sep. 26, 2016

(65) Prior Publication Data

US 2018/0086527 A1 Mar. 29, 2018

(51) Int. Cl.

| | |
|---|---|
| ***B65D 47/12*** | (2006.01) |
| ***B65D 75/48*** | (2006.01) |
| ***B65D 75/58*** | (2006.01) |

(52) U.S. Cl.

CPC ..... *B65D 75/5861* (2013.01); *B65D 47/122* (2013.01); *B65D 75/5883* (2013.01)

(58) Field of Classification Search

CPC ..... B65D 76/5883; B65D 76/5861; B65D 47/122; B65D 47/112; B65D 47/2031;

(Continued)

(56) References Cited

U.S. PATENT DOCUMENTS

| | | | |
|---|---|---|---|
| 5,087,235 | A | 2/1992 | Lafleur |
| 5,203,819 | A | 4/1993 | Gleason |

(Continued)

FOREIGN PATENT DOCUMENTS

| | | | |
|---|---|---|---|
| AU | 468475 | A | 3/1986 |
| AU | 2012212402 | B2 | 6/2016 |

(Continued)

OTHER PUBLICATIONS

Peacock, Andrew. Handbook of Polyethylenes: Structures, Properties, and Application. Dekker, 2002, p. 2.*

(Continued)

*Primary Examiner* — Lee E Sanderson

(74) *Attorney, Agent, or Firm* — Husch Blackwell LLP

(57) ABSTRACT

The present disclosure provides a flexible container. In an embodiment, the flexible container includes a first multilayer film and a second multilayer film. Each multilayer film comprises a seal layer. The multilayer films are arranged such that the seal layers oppose each other and the second multilayer film is superimposed on the first multilayer film. The multilayer films are sealed along a common peripheral edge. The flexible container includes a fitment. The fitment comprises a base. The base comprises a polymeric blend of from 60 wt % to 90 wt % ethylene/α-olefin multi-block copolymer and from 40 wt % to 10 wt % high density polyethylene (HDPE). The flexible container includes a fitment seal comprising the base located between the multilayer films. The base is sealed to each multilayer film at a portion of the common peripheral edge.

12 Claims, 5 Drawing Sheets

(58) Field of Classification Search
CPC ..... B65D 2575/583; B65D 75/008; B65B 3/045; B65B 61/186
USPC ..... 222/566, 572, 573, 92, 107; 383/120, 383/104, 119, 906; 428/35.2, 35.3, 35.4, 428/35.7
See application file for complete search history.

(56) References Cited

U.S. PATENT DOCUMENTS

| | | | | |
|---|---|---|---|---|
| 5,417,035 | A | 5/1995 | English | |
| 5,437,595 | A | 8/1995 | Smith | |
| 5,484,375 | A | 1/1996 | Owensby et al. | |
| 5,505,040 | A | 4/1996 | Janssen et al. | |
| 5,561,966 | A | 10/1996 | English | |
| 5,677,383 | A | 10/1997 | Chum et al. | |
| 5,783,638 | A | 7/1998 | Lai et al. | |
| 6,111,023 | A | 8/2000 | Chum et al. | |
| 6,729,109 | B2 | 5/2004 | Knoerzer et al. | |
| 6,984,695 | B2 | 1/2006 | Brown et al. | |
| 7,608,668 | B2 | 10/2009 | Shan et al. | |
| 7,736,288 | B2 | 6/2010 | Mizuo et al. | |
| 7,858,706 | B2 | 12/2010 | Arriola et al. | |
| 7,893,166 | B2 | 2/2011 | Shan et al. | |
| 7,908,826 | B2 | 3/2011 | Reaves et al. | |
| 7,947,793 | B2 | 5/2011 | Marchand et al. | |
| 8,075,189 | B2 | 12/2011 | Berman | |
| 8,672,182 | B2 | 3/2014 | Bonet | |
| 8,734,015 | B2 | 5/2014 | Futase | |
| 8,950,610 | B2 | 2/2015 | Schellenbach et al. | |
| 9,132,944 | B2 | 9/2015 | Schick | |
| 2003/0029138 | A1* | 2/2003 | Kobetsky | B29C 65/18 53/412 |
| 2004/0118710 | A1* | 6/2004 | Bourque | B29C 65/76 206/219 |
| 2004/0161174 | A1 | 8/2004 | Bartel et al. | |
| 2004/0256410 | A1* | 12/2004 | Last | B65D 75/5883 222/92 |
| 2005/0283895 | A1* | 12/2005 | Tilson | E03D 1/142 4/378 |
| 2006/0211819 | A1* | 9/2006 | Hoenig | C08L 23/0815 525/88 |
| 2009/0196537 | A1 | 8/2009 | Aikawa et al. | |
| 2010/0119783 | A1 | 5/2010 | Futase | |
| 2011/0062192 | A1 | 3/2011 | Graber | |
| 2011/0110613 | A1 | 5/2011 | Futase | |
| 2012/0005993 | A1 | 1/2012 | Doll | |
| 2012/0070601 | A1* | 3/2012 | Qian | C08L 23/06 428/36.92 |
| 2013/0315508 | A1 | 11/2013 | Futase | |
| 2014/0217119 | A1 | 8/2014 | Futase | |
| 2015/0175323 | A1 | 6/2015 | Barron | |
| 2016/0264765 | A1* | 9/2016 | Barry | C08L 23/06 |
| 2017/0121083 | A1 | 5/2017 | Hishinuma | |

FOREIGN PATENT DOCUMENTS

| | | | |
|---|---|---|---|
| CA | 2239006 | C | 3/2016 |
| CN | 103016890 | A | 4/2013 |
| CN | 203318776 | U | 12/2013 |
| CN | 203997078 | U | 12/2014 |
| DE | 29522009 | U1 | 5/1999 |
| EP | 820854 | B1 | 5/2001 |
| EP | 2366531 | A1 | 9/2011 |
| JP | H071587 | A | 1/1995 |
| JP | 2000-153852 | A | 6/2000 |
| JP | 2001018954 | A | 1/2001 |
| JP | 2005298038 | A | 10/2005 |
| JP | 2007159804 | A | 6/2007 |
| JP | 2010095272 | A | 4/2010 |
| JP | 2011148538 | A | 8/2011 |
| JP | 2011-231913 | A | 11/2011 |
| JP | 2015071455 | A | 4/2015 |
| WO | 2007067029 | A1 | 6/2007 |
| WO | 2009/087454 | A1 | 7/2009 |
| WO | 2009114900 | A1 | 9/2009 |
| WO | 2010058052 | A1 | 5/2010 |
| WO | 2016/149259 | A1 | 9/2016 |
| WO | 2016/149263 | A1 | 9/2016 |

OTHER PUBLICATIONS

Williams et al., Polymer Letters, vol. 6, pp. 621-624 (1968).
I.I. Potemkin et al., Physical Review E., vol. 57, No. 6, pp. 6902-6912, Jun. 1998.
A. Dobymin, J. Chem., Phys., vol. 107, No. 21, pp. 9234-9238, Dec. 1997.

* cited by examiner

FLEXIBLE FITMENT FOR FLEXIBLE CONTAINER

BACKGROUND

The present disclosure is directed to a flexible container having a flexible fitment.

Known are flexible pouches with rigid pour spouts for storage and delivery of flowable materials, often referred to as "pour-pouches." Many conventional pour-pouches utilize a rigid pour spout, with the base of the spout having winglets. Each winglet is a structure that is perpendicular to the base, each winglet extends radially away (in opposing directions) from the annular base of the spout. Winglets are used to increase the surface area of the annular base in order to promote adhesion between the spout and flexible packaging film.

Winglets, however, are problematic because they require a specialized heat seal bar to effectively seal the winglet to flexible film packaging. The specialized heat seal bar requires a unique shape that mates with the shape of the spout base and winglet. In addition, the heat seal process requires precise and mated alignment between the spout and the films to ensure the spout is in parallel alignment with the film orientation.

As such, the production of flexible pouches is replete with inefficiency due to (1) the expense of specialized heat seal equipment, (2) the production down-time for precise seal bar-winglet alignment, (3) the production down-time required for precise spout-film alignment, (4) the failure rate (leaks) due to misalignment, and (5) the quality control steps required at each stage of pour-pouch production.

The art recognizes the need for alternative processes in the production of pour-pouches. The art further recognizes the need for improved pour spouts that avoid the production drawbacks of spouts having winglets.

SUMMARY

The present disclosure provides a flexible container. In an embodiment, the flexible container includes a first multilayer film and a second multilayer film. Each multilayer film comprises a seal layer. The multilayer films are arranged such that the seal layers oppose each other and the second multilayer film is superimposed on the first multilayer film. The multilayer films are sealed along a common peripheral edge. The flexible container includes a fitment. The fitment comprises a base. The base comprises a polymeric blend of from 60 wt % to 90 wt % ethylene/α-olefin multi-block copolymer and from 40 wt % to 10 wt % high density polyethylene (HDPE). The flexible container includes a fitment seal comprising the base located between the multilayer films. The base is sealed to each multilayer film at a portion of the common peripheral edge.

DEFINITIONS

Figure 1:
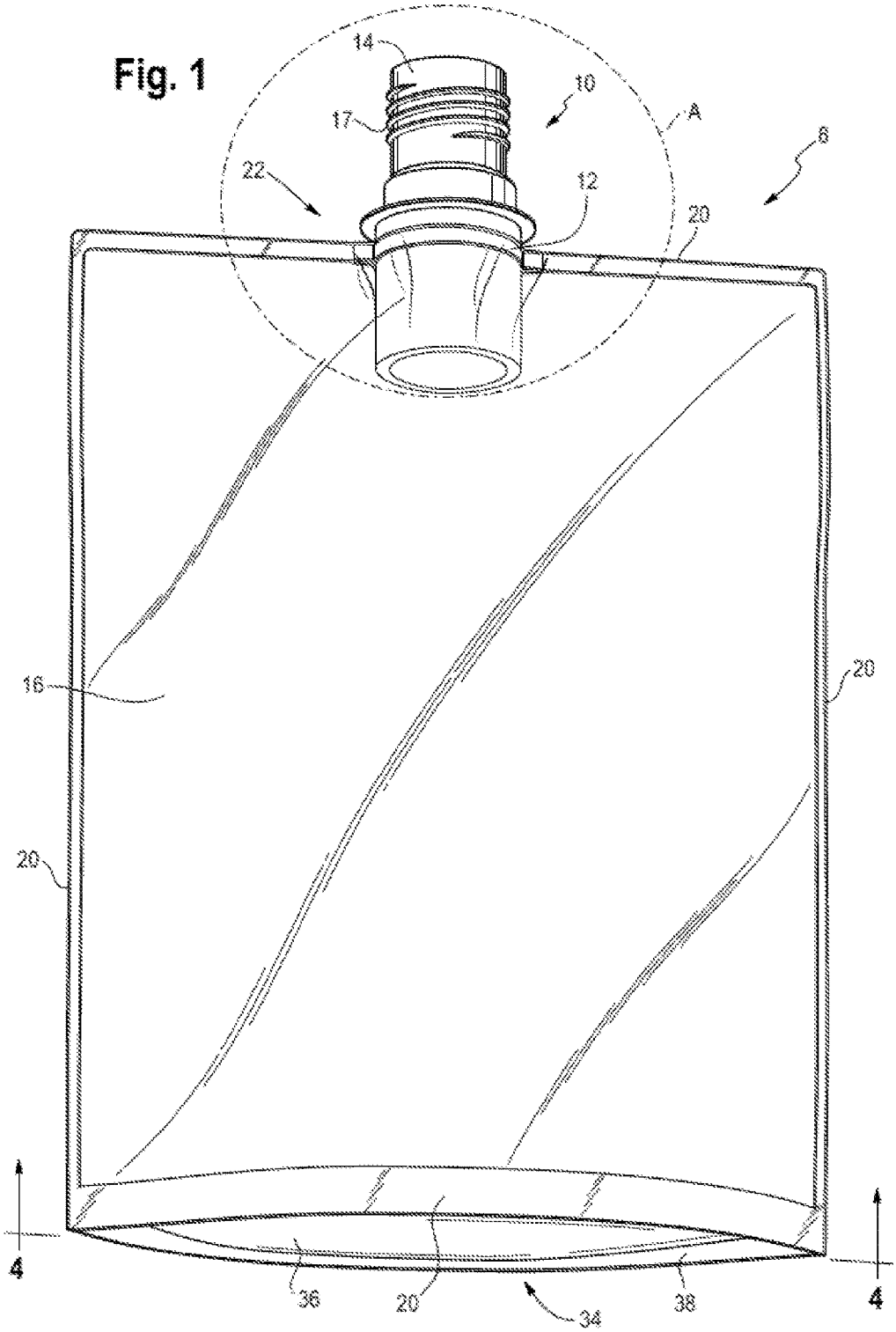
FIG. 1 is a perspective flexible container in accordance with an embodiment of the present disclosure.

All references to the Periodic Table of the Elements herein shall refer to the Periodic Table of the Elements, published and copyrighted by CRC Press, Inc., 2003. Also, any references to a Group or Groups shall be to the Groups or Groups reflected in this Periodic Table of the Elements using the IUPAC system for numbering groups. Unless stated to the contrary, implicit from the context, or customary in the art, all parts and percents are based on weight. For purposes of United States patent practice, the contents of any patent, patent application, or publication referenced herein are hereby incorporated by reference in their entirety (or the equivalent US version thereof is so incorporated by reference), especially with respect to the disclosure of synthetic techniques, definitions (to the extent not inconsistent with any definitions provided herein) and general knowledge in the art.

The numerical ranges disclosed herein include all values from, and including, the lower value and the upper value. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

Density is measured in accordance with ASTM D 792 with values reported in grams per cubic centimeter, g/cc.

Elastic recovery is measured as follows. Stress-strain behavior in uniaxial tension is measured using an Instron™ universal testing machine at 300% $min^{-1}$ deformation rate at 21° C. The 300% elastic recovery is determined from a loading followed by unloading cycle to 300% strain, using ASTM D 1708 microtensile specimens. Percent recovery for all experiments is calculated after the unloading cycle using the strain at which the load returned to the base line. The percent recovery is defined as:

$$\% \text{ Recovery}=100*(Ef-Es)/Ef$$

where Ef is the strain taken for cyclic loading and Es is the strain where the load returns to the baseline after the unloading cycle.

Elongation at break and tensile modulus each is measured in accordance with ASTM D 638. Elongation at break is the strain on a sample when it breaks. Values for elongation at break are expressed as a percent (%). Values for tensile modulus are reported in mega pascals (MPa). The ASTM D638 testing procedure entails using a nominal Type IV dogbone specimen cut from extruded tape having a nominal 0.50 mm thickness. The tensile testing is performed on an INSTRON® Tensile Tester at a 20 inch/min testing speed.

An "ethylene-based polymer" is a polymer that contains more than 50 weight percent polymerized ethylene monomer (based on the total weight of polymerizable monomers) and, optionally, may contain at least one comonomer. Ethylene-based polymer includes ethylene homopolymer, and ethylene copolymer (meaning units derived from ethylene and one or more comonomers). The terms "ethylene-based polymer" and "polyethylene" may be used interchangeably. Non-limiting examples of ethylene-based polymer (polyethylene) include low density polyethylene (LDPE) and linear polyethylene. Non-limiting examples of linear polyethylene include linear low density polyethylene (LLDPE), ultra low density polyethylene (ULDPE), very low density polyethylene (VLDPE), multi-component ethylene-based copolymer (EPE), ethylene/α-olefin multi-block copolymers (also known as olefin block copolymer (OBC)), single-site catalyzed linear low density polyethylene (m-LLDPE), substantially linear, or linear, plastomers/elastomers, and high density polyethylene (HDPE). Generally, polyethylene may be produced in gas-phase, fluidized bed reactors, liquid phase slurry process reactors, or liquid phase solution process reactors, using a heterogeneous catalyst system, such as Ziegler-Natta catalyst, a homogeneous catalyst system, comprising Group 4 transition metals and ligand structures such as metallocene, non-metallocene metal-centered, heteroaryl, heterovalent aryloxyether, phosphinimine, and others. Combinations of heterogeneous and/or homogeneous catalysts also may be used in either single reactor or dual reactor configurations.

"Low density polyethylene" (or "LDPE") consists of ethylene homopolymer, or ethylene/α-olefin copolymer comprising at least one $C_3$-$C_{10}$ α-olefin, preferably $C_3$-$C_4$ that has a density from 0.915 g/cc to 0.940 g/cc and contains long chain branching with broad MWD. LDPE is typically produced by way of high pressure free radical polymerization (tubular reactor or autoclave with free radical initiator). Nonlimiting examples of LDPE include MarFlex™ (Chevron Phillips), LUPOLEN™ (LyondellBasell), as well as LDPE products from Borealis, Ineos, ExxonMobil, and others.

"Linear low density polyethylene" (or "LLDPE") is a linear ethylene/α-olefin copolymer containing heterogeneous short-chain branching distribution comprising units derived from ethylene and units derived from at least one $C_3$-$C_{10}$ α-olefin comonomer or at least one $C_4$-$C_8$ α-olefin comonomer, or at least one $C_6$-$C_8$ α-olefin comonomer. LLDPE is characterized by little, if any, long chain branching, in contrast to conventional LDPE. LLDPE has a density from 0.910 g/cc, or 0.915 g/cc, or 0.920 g/cc, or 0.925 g/cc to 0.930 g/cc, or 0.935 g/cc, or 0.940 g/cc. Nonlimiting examples of LLDPE include TUFLIN™ linear low density polyethylene resins (available from The Dow Chemical Company), DOWLEX™ polyethylene resins (available from the Dow Chemical Company), and MARLEX™ polyethylene (available from Chevron Phillips).

"Ultra low density polyethylene" (or "ULDPE") and "very low density polyethylene" (or "VLDPE") each is a linear ethylene/α-olefin copolymer containing heterogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. ULDPE and VLDPE each has a density from 0.885 g/cc, or 0.90 g/cc to 0.915 g/cc. Nonlimiting examples of ULDPE and VLDPE include ATTANE™ ultra low density polyethylene resins (available form The Dow Chemical Company) and FLEXOMER™ very low density polyethylene resins (available from The Dow Chemical Company).

"Multi-component ethylene-based copolymer" (or "EPE") comprises units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer, such as described in patent references U.S. Pat. No. 6,111,023; U.S. Pat. No. 5,677,383; and U.S. Pat. No. 6,984,695. EPE resins have a density from 0.905 g/cc, or 0.908 g/cc, or 0.912 g/cc, or 0.920 g/cc to 0.926 g/cc, or 0.929 g/cc, or 0.940 g/cc, or 0.962 g/cc. Nonlimiting examples of EPE resins include ELITE™ enhanced polyethylene (available from The Dow Chemical Company), ELITE AT™ advanced technology resins (available from The Dow Chemical Company), SURPASS™ Polyethylene (PE) Resins (available from Nova Chemicals), and SMART™ (available from SK Chemicals Co.).

"Single-site catalyzed linear low density polyethylenes" (or "m-LLDPE") are linear ethylene/α-olefin copolymers containing homogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. m-LLDPE has density from 0.913 g/cc, or 0.918 g/cc, or 0.920 g/cc to 0.925 g/cc, or 0.940 g/cc. Nonlimiting examples of m-LLDPE include EXCEED™ metallocene PE (available from ExxonMobil Chemical), LUFLEXEN™ m-LLDPE (available from LyondellBasell), and ELTEX™ PF m-LLDPE (available from Ineos Olefins & Polymers).

"Ethylene plastomers/elastomers" are substantially linear, or linear, ethylene/α-olefin copolymers containing homogeneous short-chain branching distribution comprising units derived from ethylene and units derived from at least one $C_3$-$C_{10}$ α-olefin comonomer, or at least one $C_4$-$C_8$ α-olefin comonomer, or at least one $C_6$-$C_8$ α-olefin comonomer. Ethylene plastomers/elastomers have a density from 0.870 g/cc, or 0.880 g/cc, or 0.890 g/cc to 0.900 g/cc, or 0.902 g/cc, or 0.904 g/cc, or 0.909 g/cc, or 0.910 g/cc, or 0.917 g/cc. Nonlimiting examples of ethylene plastomers/elastomers include AFFINITY™ plastomers and elastomers (available from The Dow Chemical Company), EXACT™ Plastomers (available from ExxonMobil Chemical), Tafmer™ (available from Mitsui), Nexlene™ (available from SK Chemicals Co.), and Lucene™ (available LG Chem Ltd.).

A Triple Detector Gel Permeation Chromatography or GPC (3D-GPC or TDGPC) system consisting of a Polymer Laboratories (now Agilent) high temperature chromatograph Model 220, equipped with a 2-angle laser light scattering (LS) detector Model 2040 (Precision Detectors, now Agilent), an IR-4 infra-red detector from Polymer Char (Valencia, Spain), and a 4-capillary solution viscometer (DP) (Visotek, now Malvern) is used. Data collection is performed using Polymer Char DM 100 data acquisition box and related software (Valencia, Spain). The system is also equipped with an online solvent degassing device from Polymer Laboratories (now Agilent). High temperature GPC columns consisting of four 30 cm, 20 um mixed A LS columns from Polymer Laboratories (now Agilent) are used.

The sample carousel compartment is operated at 140° C., and the column compartment is operated at 150° C. The samples are prepared at a concentration of 0.1 grams of polymer in 50 milliliters of solvent. The chromatographic solvent and the sample preparation solvent is 1,2,4-trichlorobenzene (TCB) containing 200 ppm of 2,6-di-tert-butyl-4methylphenol (BHT). The solvent is sparged with nitrogen. The polymer samples are gently stirred at 160° C. for four hours. The injection volume is 200 microliters. The flow rate through the GPC is set at 1.0 ml/minute. Column calibration and sample molecular weight calculations are performed using Polymer Char "GPC One" software. Calibration of the GPC columns is performed with 21 narrow molecular weight distribution polystyrene standards. The molecular weights of the polystyrene standards range from 580 to 8,400,000 g/mol and are arranged in 6 "cocktail" mixtures with at least a decade of separation between the individual molecular weights. The peak molecular weights of polystyrene standards are converted to polyethylene molecular weights using the following equation (as described in T. Williams & I. M. Ward, *The Construction of a Polyethylene Calibration Curve for Gel Permeation Chromatography Using Polystyrene Fractions,* 6 J. Polymer Sci. Pt. B: Polymer Letter 621, 621-624 (1968)): $M_{polyethylene}=A(M_{polystyrene})^B$ Here, B has a value of 1.0, and the experimentally determined value of A is around 0.38 to 0.44. The column calibration curve is obtained by fitting a first order polynomial to the respective polyethylene-equivalent calibration points obtained from the above Equation to the observed elution volumes. The conventional number and weight-average molecular weights (Mn(conv) and Mw(conv), respectively) are calculated according to the following equations:

$$\overline{Mn} = \frac{\sum^{i} Wf_i}{\sum^{i} (Wf_i / M_i)}$$

$$\overline{Mw} = \frac{\sum^{i} (Wf_i * M_i)}{\sum^{i} Wf_i}$$

where, $Wf_i$ is the weight fraction of the i-th component and $M_i$ is the molecular weight of the i-th component. The molecular weight distribution (MWD) is expressed as the ratio of the weight average molecular weight (Mw) to the number average molecular weight (Mn). The A value is determined by adjusting the A value in the Williams and Ward Equation until Mw, the weight average molecular weight, calculated using the above Equation, and the corresponding retention volume polynomial agreed with the independently determined value of Mw, obtained in accordance with a linear polyethylene homopolymer reference with known absolute weight-average molecular weight of 115,000 g/mol as measured by LALLS in a manner traceable to standard homopolymer polyethylene NBS1475. The absolute weight average molecular weight (Mw(abs)) are characterized by the LS detector and IR-4 concentration detector using the following equation:

$$Mw(\text{abs}) = K_{LS} * \frac{\sum (LS_i)}{\sum (IR_i)}$$

-continued $$M_{LS,i} = K_{LS} * \frac{LS_i}{IR_i}$$

wherein $\Sigma(LS_i)$ is the response area of the LS detector, $E(IR_i)$ is the response area of the IR-4 detector, and $K_{LS}$ is the instrument constant which is determined using a standard NIST 1475 with known concentration and certificated value for the weight average molecular weight of 52,000 g/mol. The absolute molecular weight at each elution volume is calculated using the following equation:

$$M_{LS,i} = K_{LS} * \frac{LS_i}{IR_i}$$

wherein $K_{LS}$ is the determined instrument constant, $LS_i$ and $IR_i$ are the LS and IR detector responses of the same i-th elution component. The absolute number average and zeta average molecular weight are calculated with the following equations:

$$Mn(\text{abs}) = K_{LS} \frac{\sum (IR_i)}{\sum (IR_i) \Big/ \left(\frac{LS_i}{IR_i}\right)}$$

$$Mz(\text{abs}) = K_{LS} \frac{\sum IR_i * \left(\frac{LS_i}{IR_i}\right)^2}{\sum IR_i * \left(\frac{LS_i}{IR_i}\right)}$$

A linear extrapolation is performed on log $M_{LS,\ i}$-elution volume plot when the log $M_{LS,\ i}$ data scattered caused by low LS or IR detector responses.

Melt flow rate (MFR) is measured in accordance with ASTM D 1238, Condition 280° C./2.16 kg (g/10 minutes).

Melt index (MI) is measured in accordance with ASTM D 1238, Condition 190° C./2.16 kg (g/10 minutes).

Shore A hardness (and Shore D hardness) is measured in accordance with ASTM D 2240.

Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

An "olefin-based polymer," as used herein is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

DETAILED DESCRIPTION

The present disclosure provides a flexible container. In an embodiment, the flexible container comprises a first multilayer film and a second multilayer film. Each multilayer film includes a seal layer. The multilayer films are arranged such that the seal layers oppose each other and the second multilayer film is superimposed on the first multilayer film. The multilayer films are sealed along a common peripheral edge. The flexible container includes a fitment having a base. The base is formed from a blend of from 60 to 90 wt % ethylene/α-olefin multi-block copolymer and from 40 to 10 wt % high density polyethylene. The flexible container includes a fitment seal comprising the base located between the multilayer films. The base is sealed to each multilayer film along a portion of the common peripheral edge.

1. Fitment

The present flexible container includes a first multilayer film, a second multilayer film, and a fitment. In an embodiment, a flexible container 8 includes a fitment 10. The fitment 10 has a base 12, and a top 14 as shown in FIG. 1.

The fitment 10 has a base 12 and a top 14 as shown in FIG. 1. The fitment 10 is made from two or more (i.e., a blend) polymeric materials. The base 12 is made from a polymeric blend composed of an ethylene/α-olefin multi-block copolymer and a high density polyethylene. The top 14 may include suitable structure (such as threads, for example) for attachment with a closure.

In an embodiment, the base is only composed of, or is otherwise formed solely from, the polymeric blend of ethylene/α-olefin multi-block copolymer and high density polyethylene.

In an embodiment the entire fitment 10 (the base 12 and the top 14) is only composed of, or is otherwise solely formed from, the polymeric blend of ethylene/α-olefin multi-block copolymer and the high density polyethylene.

Figure 3:
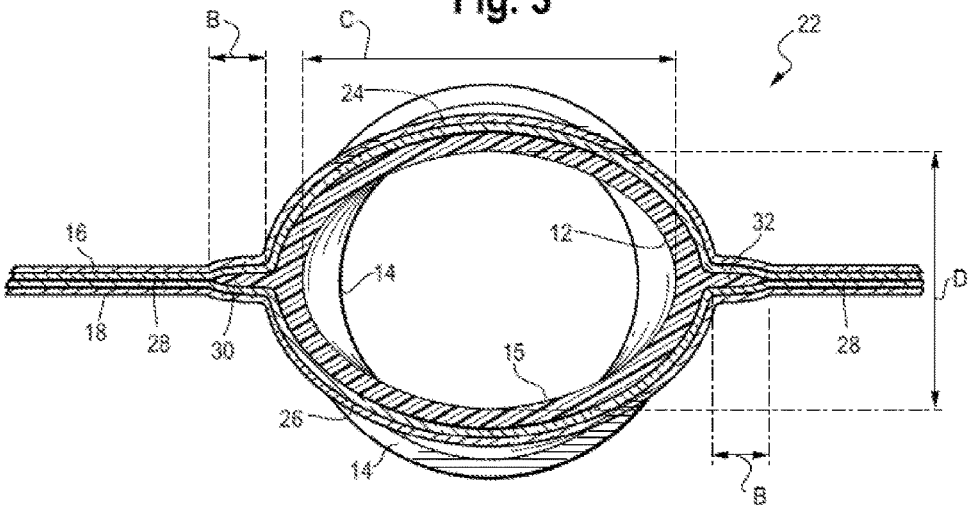
FIG. 3 is a sectional view of the pouch of FIG. 1 taken along line 3-3 of FIG. 2.

In an embodiment, the base has a wall 15, as shown in FIG. 3. The wall 15 has a thickness from 0.3 mm, or 0.4 mm, or 0.5 mm, or 0.6 mm, or 0.7 mm, or 0.8 mm, or 0.9 mm, or 1.0 mm to 1.2 mm, or 1.5 mm, or 1.7 mm, or 1.9 mm, or 2.0 mm. In a further embodiment, the wall 15 is solely composed of the polymeric blend of ethylene/α-olefin multi-block copolymer and the high density polyethylene and has the foregoing thickness.

The base 12 (and optionally the entire fitment 10) is formed from the polymeric blend of ethylene/α-olefin multi-block copolymer and high density polyethylene. The term "ethylene/α-olefin multi-block copolymer" includes ethylene and one or more copolymerizable α-olefin comonomer in polymerized form, characterized by multiple blocks or segments of two or more polymerized monomer units differing in chemical or physical properties. The term "ethylene/α-olefin multi-block copolymer" includes block copolymer with two blocks (di-block) and more than two blocks (multi-block). The terms "interpolymer" and "copolymer" are used interchangeably herein. When referring to amounts of "ethylene" or "comonomer" in the copolymer, it is understood that this means polymerized units thereof. In some embodiments, the ethylene/α-olefin multi-block copolymer can be represented by the following formula:

$$(AB)_n$$

Where n is at least 1, preferably an integer greater than 1, such as 2, 3, 4, 5, 10, 15, 20, 30, 40, 50, 60, 70, 80, 90, 100, or higher, "A" represents a hard block or segment and "B" represents a soft block or segment. Preferably, As and Bs are linked, or covalently bonded, in a substantially linear fashion, or in a linear manner, as opposed to a substantially branched or substantially star-shaped fashion. In other embodiments, A blocks and B blocks are randomly distributed along the polymer chain. In other words, the block copolymers usually do not have a structure as follows:

AAA-AA-BBB-BB

In still other embodiments, the block copolymers do not usually have a third type of block, which comprises different comonomer(s). In yet other embodiments, each of block A and block B has monomers or comonomers substantially randomly distributed within the block. In other words, neither block A nor block B comprises two or more sub-segments (or sub-blocks) of distinct composition, such as a tip segment, which has a substantially different composition than the rest of the block.

Preferably, ethylene comprises the majority mole fraction of the whole block copolymer, i.e., ethylene comprises at least 50 mole percent of the whole polymer. More preferably ethylene comprises at least 60 mole percent, at least 70 mole percent, or at least 80 mole percent, with the substantial remainder of the whole polymer comprising at least one other comonomer that is preferably an α-olefin having 3 or more carbon atoms. In some embodiments, the ethylene/α-olefin multi-block copolymer may comprise 50 mol % to 90 mol % ethylene, or 60 mol % to 85 mol %, or 65 mol % to 80 mol %. For many ethylene/octene multi-block copolymers, the composition comprises an ethylene content greater than 80 mole percent of the whole polymer and an octene content of from 10 to 15, or from 15 to 20 mole percent of the whole polymer.

The ethylene/α-olefin multi-block copolymer includes various amounts of "hard" segments and "soft" segments. "Hard" segments are blocks of polymerized units in which ethylene is present in an amount greater than 90 weight percent, or 95 weight percent, or greater than 95 weight percent, or greater than 98 weight percent based on the weight of the polymer, up to 100 weight percent. In other words, the comonomer content (content of monomers other than ethylene) in the hard segments is less than 10 weight percent, or 5 weight percent, or less than 5 weight percent, or less than 2 weight percent based on the weight of the polymer, and can be as low as zero. In some embodiments, the hard segments include all, or substantially all, units derived from ethylene. "Soft" segments are blocks of polymerized units in which the comonomer content (content of monomers other than ethylene) is greater than 5 weight percent, or greater than 8 weight percent, greater than 10 weight percent, or greater than 15 weight percent based on the weight of the polymer. In some embodiments, the comonomer content in the soft segments can be greater than 20 weight percent, greater than 25 weight percent, greater than 30 weight percent, greater than 35 weight percent, greater than 40 weight percent, greater than 45 weight percent, greater than 50 weight percent, or greater than 60 weight percent and can be up to 100 weight percent.

The soft segments can be present in an ethylene/α-olefin multi-block copolymer from 1 weight percent to 99 weight percent of the total weight of the ethylene/α-olefin multi-block copolymer, or from 5 weight percent to 95 weight percent, from 10 weight percent to 90 weight percent, from 15 weight percent to 85 weight percent, from 20 weight percent to 80 weight percent, from 25 weight percent to 75 weight percent, from 30 weight percent to 70 weight percent, from 35 weight percent to 65 weight percent, from 40 weight percent to 60 weight percent, or from 45 weight percent to 55 weight percent of the total weight of the ethylene/α-olefin multi-block copolymer. Conversely, the hard segments can be present in similar ranges. The soft segment weight percentage and the hard segment weight percentage can be calculated based on data obtained from DSC or NMR. Such methods and calculations are disclosed in, for example, U.S. Pat. No. 7,608,668, entitled "Ethylene/α-Olefin Block Interpolymers," filed on Mar. 15, 2006, in the name of Colin L. P. Shan, Lonnie Hazlitt, et al. and assigned to Dow Global Technologies Inc., the disclosure of which is incorporated by reference herein in its entirety. In particular, hard segment and soft segment weight percentages and comonomer content may be determined as described in Column 57 to Column 63 of U.S. Pat. No. 7,608,668.

The ethylene/α-olefin multi-block copolymer is a polymer comprising two or more chemically distinct regions or segments (referred to as "blocks") preferably joined (or covalently bonded) in a linear manner, that is, a polymer comprising chemically differentiated units which are joined end-to-end with respect to polymerized ethylenic functionality, rather than in pendent or grafted fashion. In an embodiment, the blocks differ in the amount or type of incorporated comonomer, density, amount of crystallinity, crystallite size attributable to a polymer of such composition, type or degree of tacticity (isotactic or syndiotactic), regio-regularity or regio-irregularity, amount of branching (including long chain branching or hyper-branching), homogeneity or any other chemical or physical property. Compared to block interpolymers of the prior art, including interpolymers produced by sequential monomer addition, fluxional catalysts, or anionic polymerization techniques, the present ethylene/α-olefin multi-block copolymer is characterized by unique distributions of both polymer polydispersity (PDI or Mw/Mn or MWD), polydisperse block length distribution, and/or polydisperse block number distribution, due, in an embodiment, to the effect of the shuttling agent(s) in combination with multiple catalysts used in their preparation.

In an embodiment, the ethylene/α-olefin multi-block copolymer is produced in a continuous process and possesses a polydispersity index (Mw/Mn) from 1.7 to 3.5, or from 1.8 to 3, or from 1.8 to 2.5, or from 1.8 to 2.2. When produced in a batch or semi-batch process, the ethylene/α-olefin multi-block copolymer possesses Mw/Mn from 1.0 to 3.5, or from 1.3 to 3, or from 1.4 to 2.5, or from 1.4 to 2.

In addition, the ethylene/α-olefin multi-block copolymer possesses a PDI (or Mw/Mn) fitting a Schultz-Flory distribution rather than a Poisson distribution. The present ethylene/α-olefin multi-block copolymer has both a polydisperse block distribution as well as a polydisperse distribution of block sizes. This results in the formation of polymer products having improved and distinguishable physical properties. The theoretical benefits of a polydisperse block distribution have been previously modeled and discussed in Potemkin, *Physical Review E* (1998) 57 (6), pp. 6902-6912, and Dobrynin, *J. Chem. Phys.* (1997) 107 (21), pp 9234-9238.

In an embodiment, the present ethylene/α-olefin multi-block copolymer possesses a most probable distribution of block lengths.

In a further embodiment, the ethylene/α-olefin multi-block copolymer of the present disclosure, especially those made in a continuous, solution polymerization reactor, possess a most probable distribution of block lengths. In one embodiment of this disclosure, the ethylene multi-block interpolymers are defined as having:

(A) Mw/Mn from about 1.7 to about 3.5, at least one melting point, Tm, in degrees Celsius, and a density, d, in grams/cubic centimeter, where in the numerical values of Tm and d correspond to the relationship:

$$Tm>-2002.9+4538.5(d)-2422.2(d)^2, \text{ or}$$

(B) Mw/Mn from about 1.7 to about 3.5, and is characterized by a heat of fusion, ΔH in J/g, and a delta quantity, ΔT, in degrees Celsius defined as the temperature difference between the tallest DSC peak and the tallest Crystallization Analysis Fractionation ("CRYSTAF") peak, wherein the numerical values of ΔT and ΔH have the following relationships:

$$\Delta T>-0.1299(\Delta H)+62.81 \text{ for } \Delta H \text{ greater than zero and up to 130 J/g}$$

$$\Delta T\geq 48^\circ \text{ C. for } \Delta H \text{ greater than 130 J/g}$$

wherein the CRYSTAF peak is determined using at least 5 percent of the cumulative polymer, and if less than 5 percent of the polymer has an identifiable CRYSTAF peak, then the CRYSTAF temperature is 30° C.; or (C) elastic recovery, Re, in percent at 300 percent strain and 1 cycle measured with a compression-molded film of the ethylene/α-olefin interpolymer, and has a density, d, in grams/cubic centimeter, wherein the numerical values of Re and d satisfy the following relationship when ethylene/α-olefin interpolymer is substantially free of crosslinked phase:

$$Re>1481-1629(d); \text{ or}$$

(D) has a molecular weight fraction which elutes between 40° C. and 130° C. when fractionated using TREF, characterized in that the fraction has a molar comonomer content of at least 5 percent higher than that of a comparable random ethylene interpolymer fraction eluting between the same temperatures, wherein said comparable random ethylene interpolymer has the same comonomer(s) and has a melt index, density and molar comonomer content (based on the whole polymer) within 10 percent of that of the ethylene/α-olefin interpolymer; or (E) has a storage modulus at 25° C., G'(25° C.), and a storage modulus at 100° C., G'(100° C.), wherein the ratio of G'(25° C.) to G'(100° C.) is in the range of about 1:1 to about 9:1.

The ethylene/α-olefin multi-block copolymer may also have:

(F) molecular fraction which elutes between 40° C. and 130° C. when fractionated using TREF, characterized in that the fraction has a block index of at least 0.5 and up to about 1 and a molecular weight distribution, Mw/Mn, greater than about 1.3; or (G) average block index greater than zero and up to about 1.0 and a molecular weight distribution, Mw/Mn greater than about 1.3.

Suitable monomers for use in preparing the present ethylene/α-olefin multi-block copolymer include ethylene and one or more addition polymerizable monomers other than ethylene. Examples of suitable comonomers include straight-chain or branched α-olefins of 3 to 30, or 3 to 20, or 4 to 8 carbon atoms, such as propylene, 1-butene, 1-pentene, 3-methyl-l-butene, 1-hexene, 4-methyl-1-pentene, 3-methyl-1-pentene, 1-octene, 1-decene, 1-dodecene, 1-tetradecene, 1-hexadecene, 1-octadecene and 1-eicosene; cyclo-olefins of 3 to 30, or 3 to 20, carbon atoms, such as cyclopentene, cycloheptene, norbornene, 5-methyl-2-norbornene, tetracyclododecene, and 2-methyl-1,4,5,8-dimethano-1,2,3,4,4a,5,8,8a-octahydronaphthalene; di- and polyolefins, such as butadiene, isoprene, 4-methyl-1,3-pentadiene, 1,3-pentadiene, 1,4-pentadiene, 1,5-hexadiene, 1,4-hexadiene, 1,3-hexadiene, 1,3-octadiene, 1,4-octadiene, 1,5-octadiene, 1,6-octadiene, 1,7-octadiene, ethylidenenorbornene, vinyl norbornene, dicyclopentadiene, 7-methyl-1,6-octadiene, 4-ethylidene-8-methyl-1,7-nonadiene, and 5,9-dimethyl-1,4,8-decatriene; and 3-phenylpropene, 4-phenylpropene, 1,2-difluoroethylene, tetrafluoroethylene, and 3,3,3-trifluoro-1-propene.

In an embodiment, the ethylene/α-olefin multi-block copolymer is void of styrene (i.e., is styrene-free).

The ethylene/α-olefin multi-block copolymer can be produced via a chain shuttling process such as described in U.S. Pat. No. 7,858,706, which is herein incorporated by reference. In particular, suitable chain shuttling agents and related information are listed in Col. 16, line 39 through Col. 19, line 44. Suitable catalysts are described in Col. 19, line 45 through Col. 46, line 19 and suitable co-catalysts in Col. 46, line 20 through Col. 51 line 28. The process is described throughout the document, but particularly in Col. Col 51, line 29 through Col. 54, line 56. The process is also described, for example, in the following: U.S. Pat. No. 7,608,668; U.S. Pat. No. 7,893,166; and U.S. Pat. No. 7,947,793.

In an embodiment, the ethylene/α-olefin multi-block copolymer has hard segments and soft segments, is styrene-free, consists of only (i) ethylene and (ii) a $C_4$-$C_8$ α-olefin comonomer, and is defined as having:

a Mw/Mn from 1.7 to 3.5, at least one melting point, Tm, in degrees Celsius, and a density, d, in grams/cubic centimeter, where in the numerical values of Tm and d correspond to the relationship:

$$Tm<-2002.9+4538.5(d)-2422.2(d)^2,$$

where d is from 0.86 g/cc, or 0.87 g/cc, or 0.88 g/cc to 0.89 g/cc;

and

Tm is from 80° C., or 85° C., or 90° C. to 95, or 99° C., or 100° C., or 105° C. to 110° C., or 115° C., or 120° C., or 125° C.

In an embodiment, the ethylene/α-olefin multi-block copolymer is an ethylene/octene multi-block copolymer (consisting only of ethylene and octene comonomer) and has one, some, any combination of, or all the properties (i)-(ix) below:

(i) a melt temperature (Tm) from 80° C., or 85° C., or 90° C. to 95, or 99° C., or 100° C., or 105° C. to 110° C., or 115° C., or 120° C., or 125° C.;

(ii) a density from 0.86 g/cc, or 0.87 g/cc, or 0.88 g/cc to 0.89 g/cc;

(iii) 50-85 wt % soft segment and 40-15 wt % hard segment;

(iv) from 10 mol %, or 13 mol %, or 14 mol %, or 15 mol % to 16 mol %, or 17 mol %, or 18 mol %, or 19 mol %, or 20 mol % octene in the soft segment;

(v) from 0.5 mol %, or 1.0 mol %, or 2.0 mol %, or 3.0 mol % to 4.0 mol %, or 5 mol %, or 6 mol %, or 7 mol %, or 9 mol % octene in the hard segment;

(vi) a melt index (MI) from 1 g/10 min, or 2 g/10 min, or 5 g/10 min, or 7 g/10 min to 10 g/10 min, or 15 g/10 min to 20 g/10 min;

(vii) a Shore A hardness from 65, or 70, or 71, or 72 to 73, or 74, or 75, or 77, or 79, of 80;

(viii) an elastic recovery (Re) from 50%, or 60% to 70%, or 80%, or 90%, at 300% 300% $min^{-1}$ deformation rate at 21° C. as measured in accordance with ASTM D 1708.

(ix) a polydisperse distribution of blocks and a polydisperse distribution of block sizes.

In an embodiment, the ethylene/α-olefin multi-block copolymer is an ethylene/octene multi-block copolymer.

The present ethylene/α-olefin multi-block copolymer may comprise two or more embodiments disclosed herein.

In an embodiment, the ethylene/octene multi-block copolymer is sold under the Tradename INFUSE™ is available from The Dow Chemical Company, Midland, Mich., USA. In a further embodiment, the ethylene/octene multi-block copolymer is INFUSE™ 9817.

In an embodiment, the ethylene/octene multi-block copolymer is INFUSE™ 9500.

In an embodiment, the ethylene/octene multi-block copolymer is INFUSE™ 9507.

2. High Density Polyethylene

The base (and optionally the entire fitment) is composed of a polymeric blend of the ethylene/α-olefin multi-block copolymer and a high density polyethylene. A "high density polyethylene" (or "HDPE") is an ethylene homopolymer or an ethylene/α-olefin copolymer with at least one $C_3$-$C_{10}$ α-olefin comonomer, and has a density from greater than 0.940 g/cc, or 0.945 g/cc, or 0.950 g/cc, or 0.955 g/cc, to 0.960 g/cc, or 0.965 g/cc, or 0.970 g/cc, or 0.975 g/cc, or 0.980 g/cc. Nonlimiting examples of suitable comonomers include propylene, 1-butene, 1 pentene, 4-methyl-1-pentene, 1-hexene, and 1-octene. The HDPE includes at least 50 percent by weight units derived from ethylene, i.e., polymerized ethylene, or at least 70 percent by weight, or at least 80 percent by weight, or at least 85 percent by weight, or at least 90 weight percent, or at least 95 percent by weight ethylene in polymerized form. The HDPE can be a monomodal copolymer or a multimodal copolymer. A "monomodal ethylene copolymer" is an ethylene/$C_4$-$C_{10}$ α-olefin copolymer that has one distinct peak in a gel permeation chromatography (GPC) showing the molecular weight distribution. A "multimodal ethylene copolymer" is an ethylene/$C_4$-$C_{10}$ α-olefin copolymer that has at least two distinct peaks in a GPC showing the molecular weight distribution. Multimodal includes copolymer having two peaks (bimodal) as well as copolymer having more than two peaks.

In an embodiment, the HDPE has one, some, or all of the following properties: and has one, some, any combination of, or all the properties (i)-(iv) below:

(i) a density from 0.950 g/cc, or 0.955 g/cc, or 0.960 g/cc to 0.965 g/cc, or 0.970 g/cc, or 0.975 g/cc, or 0.980 g/cc; and/or (ii) a melt index (MI) from 0.5 g/10 min, or 1.0 g/10 min, or 1.5 g/10 min, or 2.0 g/10 min, to 2.5 g/10 min, or 3.0; and/or (iii) a melt temperature (Tm) from 125° C., or 128° C., or 130° C. to 132° C., or 135° C., or 137° C.; and/or (iv) a bimodal molecular weight distribution.

In an embodiment, the HDPE has a density from 0.955 g/cc, or 0.957 g/cc, or 0.959 g/cc to 0.960 g/cc, or 0.963 g/cc, or 0.965 g/cc and has a melt index from 1.0 g/10 min, or 1.5 g/10 min, or 2.0 g/10 min to 2.5 g/10 min, or 3.0 g/10 min.

Nonlimiting examples of suitable, commercially available HDPE include, but are not limited to, Dow High Density Polyethylene resins sold under the trade names CONTINUUM™ and UNIVAL™.

HDPE is distinct from each of the following types of ethylene-based polymer: LLDPE, m-LLDPE ULDPE, VLDPE, EPE, ethylene/α-olefin multi-block copolymer, ethylene plastomers/elastomers, and LDPE.

The base and/or the entire fitment is composed of the ethylene/α-olefin multi-block copolymer/HDPE polymeric blend. The polymeric blend of ethylene/α-olefin multi-block copolymer and HDPE includes from 60 wt %, or 65 wt %, or 70 wt %, or 75 wt % to 80 wt %, or 85 wt %, or 90 wt % of the ethylene/α-olefin multi-block copolymer and a reciprocal amount of HDPE or from 40 wt %, or 35 wt %, or 30 wt %, or 25 wt % to 20 wt %, or 15 wt %, or 10 wt % HDPE.

In an embodiment, the entire fitment is composed of only the ethylene/α-olefin multi-block copolymer and HDPE polymeric blend which includes from 70 wt %, or 73 wt %, or 75 wt % to 78 wt %, or 80 wt %, or 83 wt %, or 85 wt %, or 87 wt %, or 90 wt % of the ethylene/α-olefin multi-block copolymer and a reciprocal amount of HDPE or from 30 wt %, or 27 wt %, or 25 wt % to 22 wt %, or 20 wt %, or 17 wt %, or 15 wt %, or 13 wt %, or 10 wt % of the HDPE.

In an embodiment, the entire fitment is composed of only the ethylene/α-olefin multi-block copolymer and HDPE polymeric blend which includes from 70 wt %, or 73 wt %, or 75 wt % to 78 wt %, or 80 wt %, or 83 wt %, or 85 wt %, or 87 wt %, or 90 wt % of the ethylene/α-olefin multi-block copolymer and a reciprocal amount of HDPE or from 30 wt %, or 27 wt %, or 25 wt % to 22 wt %, or 20 wt %, or 17 wt %, or 15 wt %, or 13 wt %, or 10 wt % of the HDPE and the polymeric blend has one, some, or all of the following properties:

(i) Shore A hardness (Shore D hardness in parentheses) from 80 (29), or 83 (31), or 85 (33), or 87 (35), or 89 (38), or 90 (39), or 91 (40), or 93 (44), or 95 (46), or 97 (50), or 99 (56), or 100 (59); and/or (ii) an elongation at break from 180%, or 200%, or 220%, or 240%, or 260%, or 280%, or 300%, or 320% to 340%, or 360%, or 380%, or 400%, or 410%; and/or (iii) a tensile modulus from 50 MPa, or 75 MPa, or 100 MPa, or 125 MPa, or 150 MPa, or 175 MPa, or 200 MPa to 225 MPa, or 250 MPa, or 275 MPa.

Nonlimiting examples of ethylene/α-olefin multi-block copolymer and HDPE polymeric blends for the fitment and related properties are set forth in Table 1 below.

TABLE 1

Polymeric blends with ethylene/α-olefin multi-block copolymer and varying amounts of HDPE

| Wt % HDPE in Blend with ethylene/α-olefin multi-block copolymer | Elongation at Break, % ASTM D638 Tensile Type IV specimens tested at 20 inch/min | Tensile Modulus (MPa) | Hardness, Shore A ASTM D2240 |
|---|---|---|---|
| 0 (100)* | 828 | 17.7 | 76.2 |
| 10 (90) | 406 | 56.6 | 87.7 |
| 15 (85) | 382 | 70.0 | 88.4 |
| 20 (80) | 357 | 94.2 | 89.6 |
| 25 (75) | 307 | 119 | 92.4 |
| 30 (70) | 246 | 145 | 93.7 |
| 35 (65) | 188 | 221 | 94.1 |
| 40 (60) | 185 | 262 | 94.8 |

*Reciprocal amount of ethylene/α-olefin multi-block copolymer in parentheses ethylene/α-olefin multi-block copolymer - INFUSE 4817 HDPE = DMDC-1250 NT 7

3. Multilayer Films

The present flexible container includes a first multilayer film and a second multilayer film. In an embodiment, the flexible container 8 includes a first multilayer film 16 (a front film) and a second multilayer film 18 (a rear film) as shown in FIG. 1. The term 'first multilayer film" and the term "front film" are used interchangeably. The term "second multilayer film" and the term "rear film" are used interchangeably.

The fitment base 10 is placed between two opposing multilayer films and subsequently sealed thereto. Each multilayer film 16, 18 has a respective seal layer containing an olefin-based polymer.

In an embodiment, each multilayer film 16, 18 is made from a flexible film having at least one, or at least two, or at least three layers. The flexible film is resilient, flexible, deformable, and pliable. The structure and composition for each flexible film 16, 18 may be the same or may be different. For example, each multilayer film 16, 18 can be made from a separate web, each web having a unique structure and/or unique composition, finish, or print. Alternatively, each multilayer film 16, 18 can be the same structure and the same composition.

The flexible multilayer film is composed of a polymeric material. Nonlimiting examples of suitable polymeric material include olefin-based polymer; propylene-based polymer; ethylene-based polymer; polyamide (such as nylon), ethylene-acrylic acid or ethylene-methacrylic acid and their ionomers with zinc, sodium, lithium, potassium, or magnesium salts; ethylene vinyl acetate (EVA) copolymers; and blends thereof. The flexible multilayer film can be either printable or compatible to receive a pressure sensitive label or other type of label for displaying of indicia on the flexible container 8.

In an embodiment, a flexible multilayer film is provided and includes at least three layers: (i) an outermost layer, (ii) one or more core layers, and (iii) an innermost seal layer. The outermost layer (i) and the innermost seal layer (iii) are surface layers with the one or more core layers (ii) sandwiched between the surface layers. The outermost layer may include (a-i) a HDPE, (b-ii) a propylene-based polymer, or combinations of (a-i) and (b-ii), alone, or with other olefin-based polymers such as LDPE. Nonlimiting examples of suitable propylene-based polymers include propylene homopolymer, random propylene/α-olefin copolymer (majority amount propylene with less than 10 weight percent ethylene comonomer), and propylene impact copolymer (heterophasic propylene/ethylene copolymer rubber phase dispersed in a matrix phase).

With the one or more core layers (ii), the number of total layers in the present multilayer film (16, 18) can be from three layers (one core layer), or four layers (two core layers), or five layers (three core layers, or six layers (four core layers), or seven layers (five core layers) to eight layers (six core layers), or nine layers (seven core layers), or ten layers (eight core layers), or eleven layers (nine core layers), or more.

Each multilayer film 16, 18 has a thickness from 75 microns, or 100 microns, or 125 microns, or 150 microns to 200 microns, or 250 microns or 300 microns or 350 microns, or 400 microns.

In an embodiment, each multilayer film 16, 18 a flexible multilayer film having the same structure and the same composition.

The flexible multilayer film 16, 18 may be (i) a coextruded multilayer structure or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and/or optical properties.

In an embodiment, the outermost layer includes a HDPE. In a further embodiment, the HDPE is a substantially linear multi-component ethylene-based copolymer (EPE) such as ELITE™ resin provided by The Dow Chemical Company.

In an embodiment, each core layer includes one or more linear or substantially linear ethylene-based polymers or block copolymers having a density from 0.908 g/cc, or 0.912 g/cc, or 0.92 g/cc, or 0.921 g/cc to 0.925 g/cc, or less than 0.93 g/cc. In an embodiment, each of the one or more core layers includes one or more ethylene/$C_3$-$C_8$ α-olefin copolymers selected from linear low density polyethylene (LLDPE), ultralow density polyethylene (ULDPE), very low density polyethylene (VLDPE), EPE, olefin block copolymer (OBC), plastomers/elastomers, and single-site catalyzed linear low density polyethylenes (m-LLDPE).

In an embodiment, the seal layer includes one or more ethylene-based polymers having a density from 0.86 g/cc, or 0.87 g/cc, or 0.875 g/cc, or 0.88 g/cc, or 0.89 g/cc to 0.90 g/cc, or 0.902 g/cc, or 0.91 g/cc, or 0.92 g/cc. In a further embodiment, the seal layer includes one or more ethylene/$C_3$-$C_8$ α-olefin copolymers selected from EPE, plastomers/elastomers, or m-LLDPE.

In an embodiment, the flexible multilayer film is a coextruded film, the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cm$^3$, or from 0.875 to 0.910 g/cm$^3$, or from 0.888 to 0.900 g/cm$^3$ and the outer layer is composed of a polyamide having a Tm from 170° C. to 270° C.

In an embodiment, the flexible multilayer film is a coextruded and/or laminated film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and a density from 0.865 to 0.925 g/cm$^3$, or from 0.875 to 0.910 g/cm$^3$, or from 0.888 to 0.900 g/cm$^3$ and an outermost layer composed of a material selected from HDPE, EPE, LLDPE, OPET (biaxially oriented polyethylene terephthalate), OPP (oriented polypropylene), BOPP (biaxially oriented polypropylene), polyamide, and combinations thereof.

In an embodiment, the flexible multilayer film is a coextruded and/or laminated film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$. The outer layer is composed of a material selected from HDPE, EPE, LLDPE, OPET, OPP, BOPP, polyamide, and combinations thereof.

In an embodiment, the flexible multilayer film is a coextruded (or laminated) film of three or more layers where all layers consist of ethylene-based polymers. In a further embodiment, the flexible multilayer film is a coextruded (or laminated) film of three or more layers where each layer consists of ethylene-based polymers and (1) the seal layer is composed of a linear or substantially linear ethylene-based polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$ and (2) the outer layer includes one or more ethylene-based polymers selected from HDPE, EPE, LLDPE or m-LLDPE and (3) each of the one or more core layers includes one or more ethylene/$C_3$-$C_8$ α-olefin copolymers selected from low density polyethylene (LDPE), linear low density polyethylene (LLDPE), ultralow density polyethylene (ULDPE), very low density polyethylene (VLDPE), EPE, olefin block copolymer (OBC), plastomers/elastomers, and single-site catalyzed linear low density polyethylenes (m-LLDPE).

In an embodiment, the flexible multilayer film is a coextruded and/or laminated five layer, or a coextruded (or laminated) seven layer film having at least one layer containing OPET or OPP.

In an embodiment, the flexible multilayer film is a coextruded (or laminated) five layer, or a coextruded (or laminated) seven layer film having at least one layer containing polyamide.

In an embodiment, the flexible multilayer film is a seven-layer coextruded (or laminated) film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 106° C. The outer layer is a polyamide having a Tm from 170° C. to 270° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

4. Fitment Seal

The front film 16 and the rear film 18 are sealed around a common peripheral edge 20. The flexible container 8 includes a fitment seal 22 located along a portion of the peripheral edge 20. The fitment seal 22 includes the base 12 sandwiched between front film 16 and rear film 18, (ii) a weld 24 between the front film 16 and the base 12, (iii) a weld 26 between the rear film 18 and the base 12, (iv) a weld 28 between front film 16 and rear film 18, and (v) in situ winglet 30, and in situ winglet 32 extending from opposing sides of the base 12 as shown in FIG. 3.

The fitment seal 22 is formed by a single-stage heat seal process whereby opposing seal bars having concave surfaces seal the film-base-film sandwich to form the in situ winglets 30, 32 as disclosed in copending case U.S. Ser. No. 15/276,014 filed on Sep. 26, 2016. Welds 24, 26, 28 are formed by way of a heat seal process which melts, or otherwise places in a flowable state, (i) a portion the olefin-based polymer in the seal layer of each respective multilayer film 16, 18 and (ii) a portion of the polymeric blend of ethylene/α-olefin multi-block copolymer and HDPE present in the base 12. In this way, weld 24 and weld 26 are composed of, or otherwise formed from, (i) the ethylene/α-olefin multi-block copolymer and HDPE (from the base 12), (ii) the olefin-based polymer (from the seal layer), or (iii) a combination of (i) and (ii). Weld 28 is composed of, or otherwise formed from, the olefin-based polymers from the multilayer films 16, 18.

The in situ winglets 30, 32 are formed during the heat seal process which creates the fitment seal 22. An "in situ winglet," as used herein, is a structure that is an extension of the base 12, the in situ winglet being the polymeric solidification of a flowable caulk composed of the ethylene/α-olefin multi-block copolymer (from the base 12), the caulk created when the base is flattened under heat, the caulk solidified when joint gaps between the films and the base are subsequently pinched and closed. The in situ winglets are composed of, or otherwise are formed from, (i) the ethylene/α-olefin multi-block copolymer and HDPE (from the base 12), or (ii) a blend of the ethylene/α-olefin multi-block copolymer and the olefin-based polymer (from the seal layer).

The heat and stress of seal bar sealing of fitment to film to make containers is limited. A fitment composed of low elasticity polyolefin (e.g., solely LDPE, or solely HDPE) crushes, cracks, breaks, and is unusable. A fitment composed of a polyolefin elastomer (e.g., ENGAGE or VERSIFY elastomers) can exhibit deformation, yet does not recover adequately or welds shut. A fitment composed of a cross-linked elastomer (e.g., TPV) may fully recover but does not seal adequately and does not form a hermetic seal. Applicant surprisingly discovered that a fitment composed of the present polymeric blend of ethylene/α-olefin multi-block copolymer and HDPE recovers (recoils) and will not seal to itself, and will seal the fitment of the film of the container using opposing seal bar heat sealing techniques. In particular, the base 12 composed of the present blend of ethylene/α-olefin multi-block copolymer and HDPE with elastic recovery from 50% to 90% advantageously is flexible enough to be sealed without crazing, cracking or breaking and yet elastic enough to recoil, spring back, and open to an elliptical cross section shape post-seal.

In an embodiment, each in situ winglet has a length B (FIG. 3) from 0.5 mm, or 1.0 mm, or 2.0 mm, or 3.0 mm, or 4.0 mm, or 5.0 mm.

In an embodiment, the base 12 has a wall 15. The wall 15 has a thickness from 0.3 mm, or 0.4 mm, or 0.5 mm, or 0.6 mm, or 0.7 mm, or 0.8 mm, or 0.9 mm, or 1.0 mm to 1.2 mm, or 1.5 mm, or 1.7 mm, or 1.9 mm, or 2.0 mm.

In an embodiment, the base 12 has a cross-section having an elliptical shape. Nonlimiting examples of elliptical shape include circular, substantially circular, lenticular, and biconvex.

In an embodiment, the elliptical cross section has a major axis C and a minor axis D as shown in FIG. 3. The length ratio (in mm) of the major axis to the minor axis is from 4:1, or 3:1 or 2:1 to 1:1.

In an embodiment, the fitment seal 22 is a hermetic seal.

In an embodiment, the fitment seal 22 is a hard seal. A "hard seal," as used herein, is a heat seal that is not manually separable without destruction of the film. A hard seal is different than a frangible seal. A "frangible seal," as used herein, is a heat seal that is manually separable (or peelable) without destruction of the film. In general, a frangible seal is designed to be separable or openable with application of finger pressure or hand pressure to the seal. A hard seal is designed to remain intact with application of finger pressure or hand pressure to the seal.

5. Flexible Container

The present flexible container can be a box pouch, pillow pouch, spout k-sealed pouch, spout side gusseted pouch. The location of the fitment (spout or valve or other) installed into the container can be anywhere a seal exists between two films, i.e., on top, side or even on bottom in the seal of bottom gusset to front panel, for example. In other words, the fitment seal 22 can be located, or otherwise formed, on the flexible container anywhere where two films meet and are heat sealed together. Nonlimiting examples of suitable locations for the fitment seal 22 include top, bottom, side, corner, gusset areas of the flexible container.

The present flexible container can be formed with or without handles.

Figure 4:
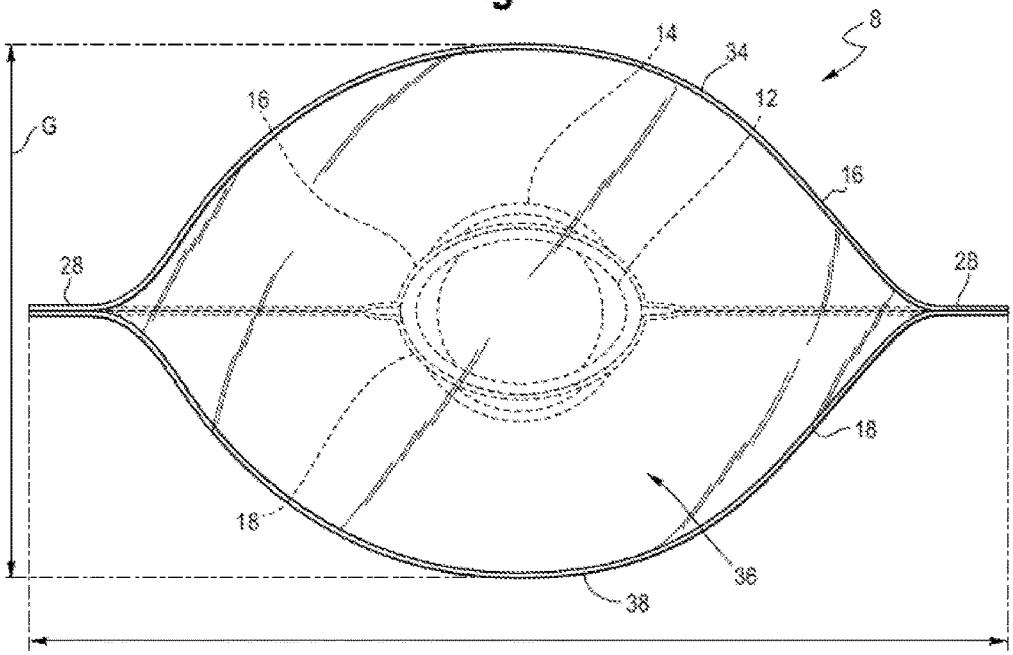
FIG. 4 is a bottom plan view of the flexible container of FIG. 1.
Figure 5:
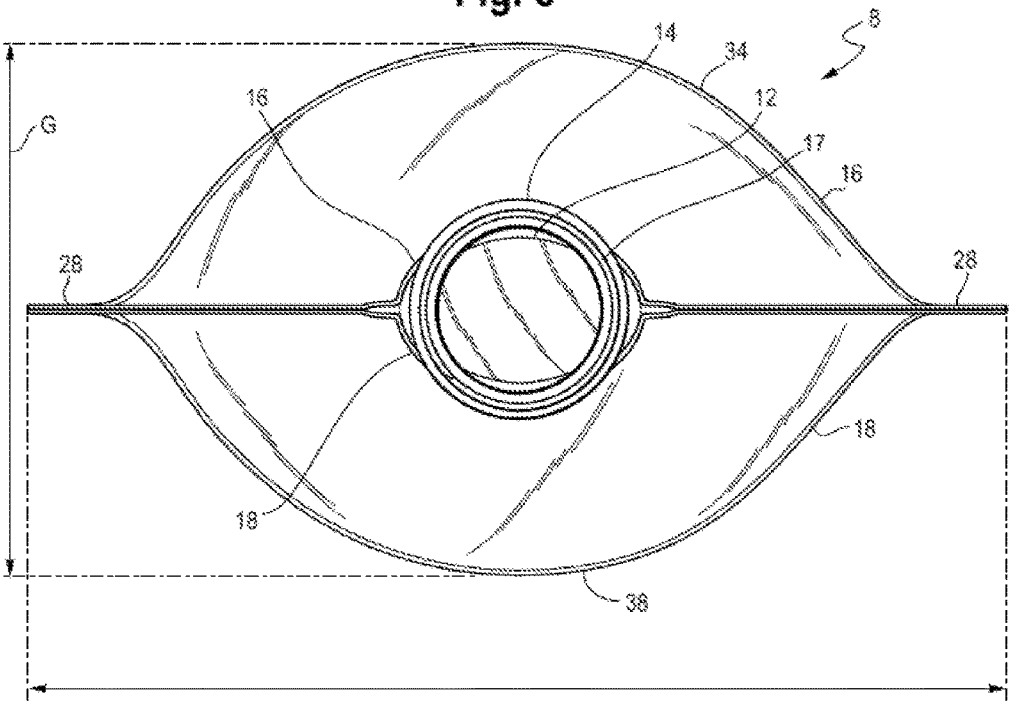
FIG. 5 is a top plan view of the flexible container of FIG. 1.

In an embodiment, the flexible container is a stand up pouch (SUP) as shown in FIGS. 1 and 4. The SUP includes a gusset 34. The gusset 34 is attached to, or otherwise extends from, a lower portion of the front film 16 and/or a lower portion of the rear film 18. The gusset 34 includes a gusset film 36 and a gusset rim 38. The gusset 34 may be formed by way of heat seal, weld (ultrasonic or high frequency or radio frequency), adhesive bond, and combinations thereof. The gusset 34, the films 16, 18, and the fitment seal 22 define a closed and hermetically sealed chamber for holding a flowable substance, such as liquid, for example.

The gusset 34 is made of a flexible polymeric material. In an embodiment, the gusset 34 is made from a multilayer film with the same structure and composition as the front film 16 and the rear film 18. The gusset 34 provides (1) the structural integrity to support the SUP and its contents without leakage, and (2) the stability for the SUP to stand upright (i.e., base on a support surface, such as a horizontal surface, or a substantially horizontal surface), without tipping over. In this sense, the pouch is a "stand-up" pouch.

In an embodiment, the gusset 34 is an extension of one or both multilayer films 16, 18. A folding procedure forms the gusset 34 from one, or both, of the films 16, 18.

The gusset rim 38 defines a footprint for the SUP. The footprint can have a variety of shapes. Nonlimiting examples of suitable shapes for the footprint include circle, square, rectangle, triangle, oval, ellipsoid, eye-shape, and teardrop. In a further embodiment, the shape of the footprint is ellipsoid.

In an embodiment, the flexible container includes a closure. Nonlimiting examples of suitable fitments and closures, include, screw cap, flip-top cap, snap cap, liquid or beverage dispensing fitments (stop-cock or thumb plunger), Colder fitment connector, tamper evident pour spout, vertical twist cap, horizontal twist cap, aseptic cap, vitop press, press tap, push on tap, lever cap, conro fitment connector, and other types of removable (and optionally reclosable) closures. The closure and/or fitment may or may not include a gasket.

Figure 1A:
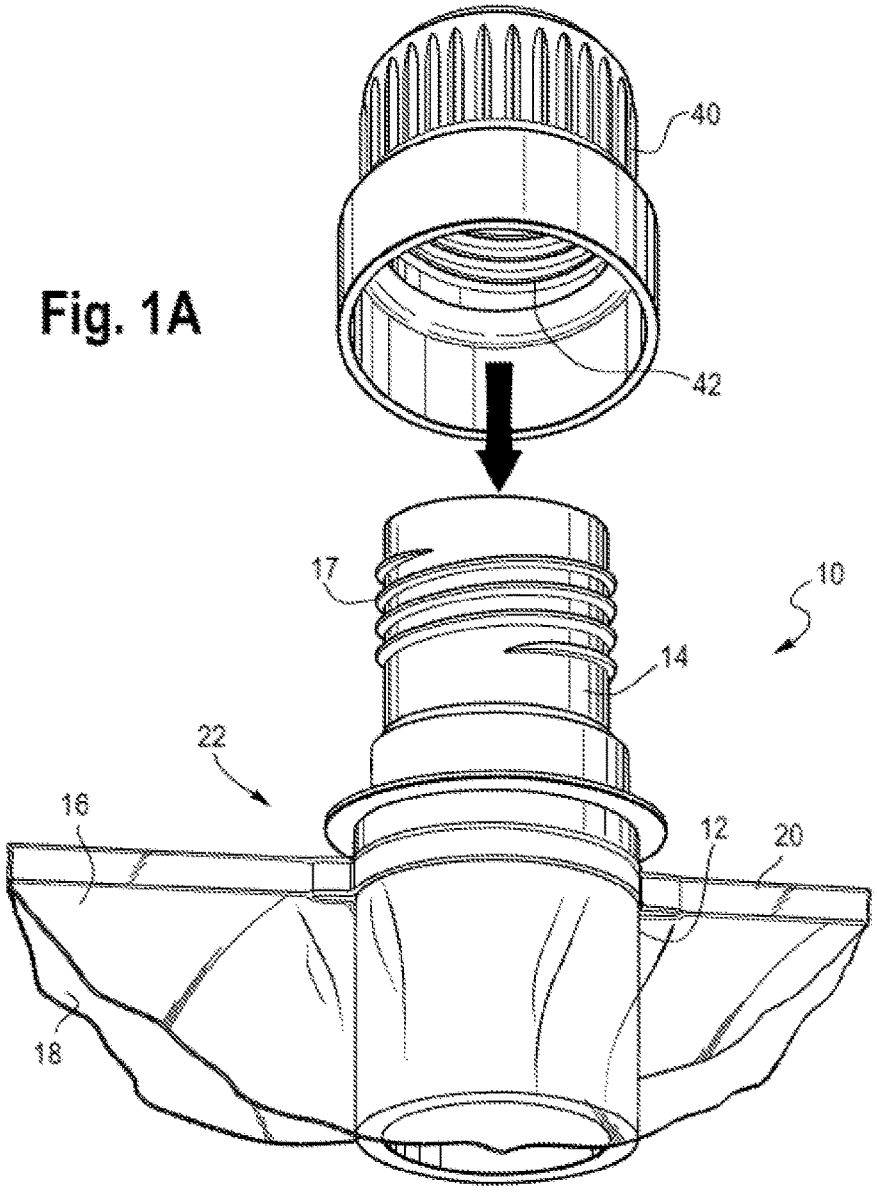
FIG. 1A is an enlarged view of area A of FIG. 1, the flexible container having a closure, in an embodiment of the present disclosure.
Figure 1B:
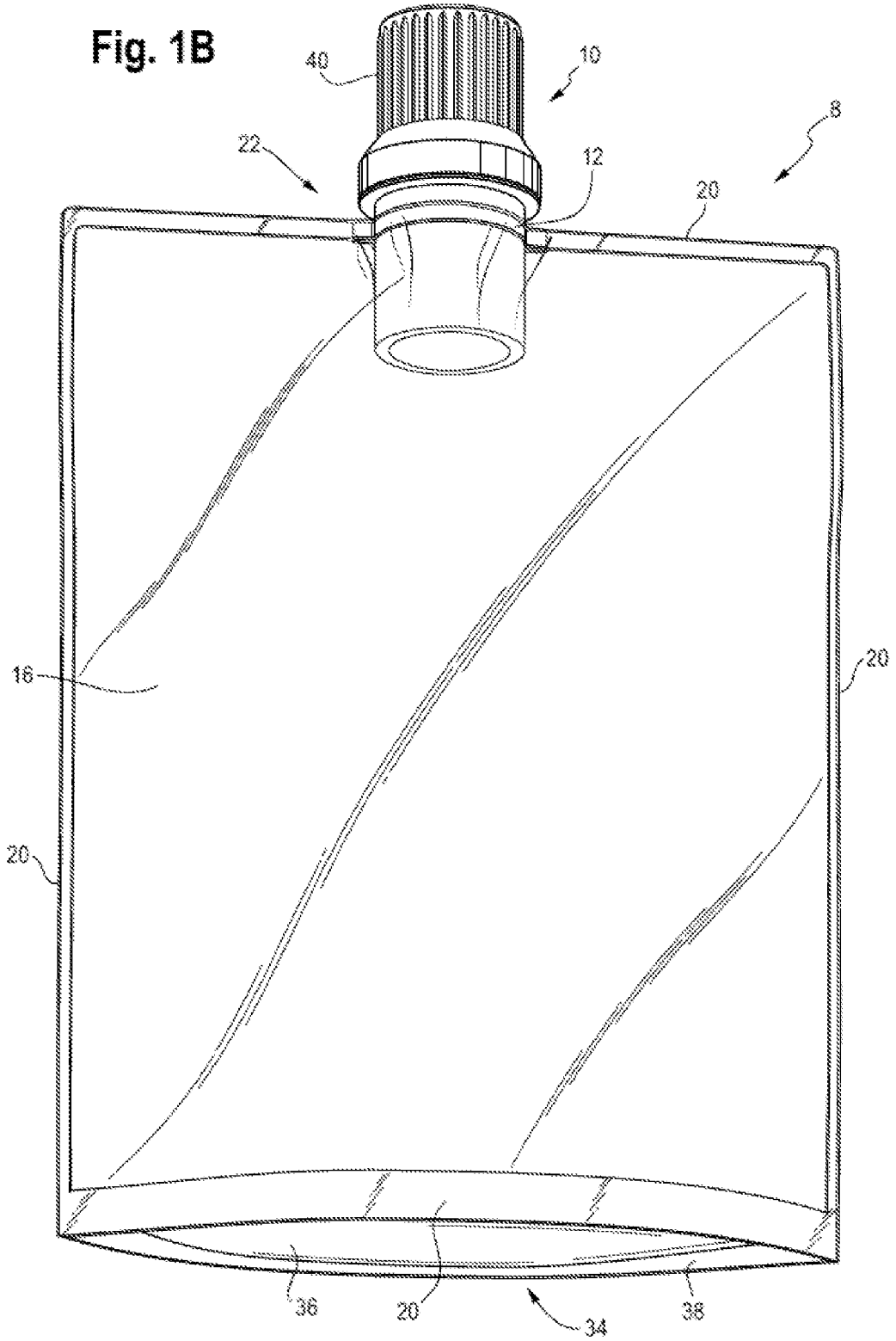
FIG. 1B is a perspective view of the flexible container of FIG. 1 with a closure in accordance with an embodiment of the present disclosure.
Figure 2:
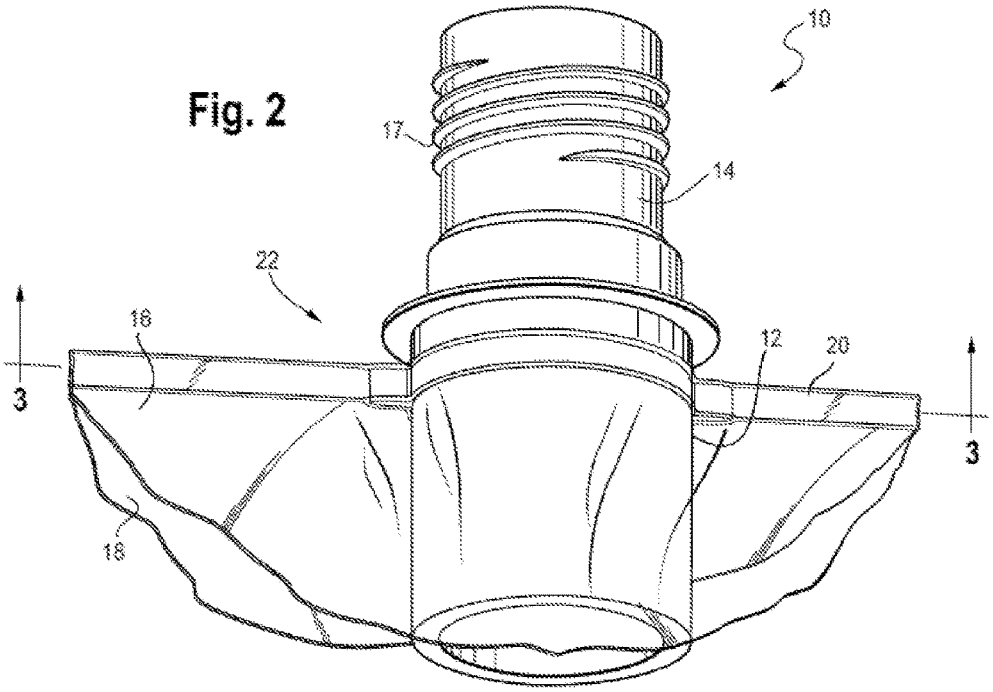
FIG. 2 is an enlarged view of area A of FIG. 1.

In an embodiment, the flexible container includes a closure that is a screwcap 40 as shown in FIGS. 1A and 1B. Threads 17 on the fitment top 14 and reciprocal threads 42 in the screwcap 40 engage with each other to provide an airtight seal between the fitment 10 and the screwcap 40 when the screwcap is fully screwed onto the fitment 10.

In an embodiment, the flexible container 8 has a volume from 0.25 liters (L), or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

In an embodiment, the present flexible container is made from 90 wt % to 100 wt % ethylene-based polymer—the films 16, 18 and gusset 34 being composed of flexible multiple layer film with layer materials selected from ethylene-based polymer such as LLDPE, LDPE, HDPE, and combinations thereof, and the fitment 10 composed of the polymeric blend of ethylene/α-olefin multi-block copolymer and HDPE. Weight percent is based on total weight of the flexible container (without content). The flexible container made from 90 wt % to 100 wt % ethylene-based polymer is advantageous as it is readily recyclable.

The present flexible container is suitable for storage of flowable substances including, but not limited to, liquid comestibles (such as beverages), oil, paint, grease, chemicals, suspensions of solids in liquid, and solid particulate matter (powders, grains, granular solids). Nonlimiting examples of suitable liquids include liquid personal care products such as shampoo, conditioner, liquid soap, lotion, gel, cream, balm, and sunscreen. Other suitable liquids include household care/cleaning products and automotive care products. Other liquids include liquid food such as condiments (ketchup, mustard, mayonnaise) and baby food.

The present flexible container is suitable for storage of flowable substances with higher viscosity and requiring application of a squeezing force to the container in order to discharge. Nonlimiting examples of such squeezable and flowable substances include grease, butter, margarine, soap, shampoo, animal feed, sauces, and baby food.

By way of example, and not limitation, examples of the present disclosure are provided.

EXAMPLES

Flexible multilayer films with structures shown in Table 2 below are used in the present examples.

1. Multilayer Films

TABLE 2

Composition of the Flexible Multilayer Film (Film 1)
Laminated Multilayer Film

| Material | Description | Density ($g/cm^3$) ASTM D792 | Melt Index (g/10 min) ASTM D1238 | Melting Point (° C.) DSC | Thickness (micrometer) |
|---|---|---|---|---|---|
| LLDPE | Dowlex ™ 2049 | 0.926 | 1 | 121 | 20 |
| HDPE | Elite ™ 5960G | 0.962 | 0.85 | 134 | 20 |
| LLDPE | Elite ™ 5400G | 0.916 | 1 | 123 | 19 |
| Adhesive Layer | Polyurethane solvent less adhesive (ex. Morfree 970/CR137) | | | | 2 |
| HDPE | Elite ™ 5960G | 0.962 | 0.85 | 134 | 19 |
| HDPE | Elite ™ 5960G | 0.962 | 0.85 | 134 | 20 |
| Seal Layer | Affinity ™ 1146 | 0.899 | 1 | 95 | 20 |
| | Total | | | | 120 |

2. Fitments

Nine comparative samples (CS) and four inventive examples (IE) of fitments are prepared. The dimensions for each fitment are identical, with only the material varying across the fitments. The CS fitments are composed of 100 wt % INFUSE 9817. The inventive fitments are composed of 70 wt % INFUSE 9817 and 30 wt % DMDC-1250 NT 7 HDPE. Each fitment has a base wall with a thickness of 0.8 mm and a base inside diameter of 12.5 mm, and a base outside diameter of 14.1 mm.

The material and composition for fitments are shown in Table 3 below.

TABLE 3

Materials for Fitments

| Material | Description | Properties | Source |
|---|---|---|---|
| INFUSE 9817 | Ethylene/octene multi-block copolymer | d: 0.877 g/cc<br>Tm: 120° C.<br>MI: 15 g/10 min | The Dow Chemical Company |
| Continuum DMDC-1250 NT 7 | HDPE<br>Ethylene/hexene copolymer with less than 2 wt % hexene | d: 0.955 $g/cm^3$<br>Tm: 130° C.<br>MI: 1.5 g/10 min | The Dow Chemical Company |

3. Processing Conditions

Each fitment is placed between two opposing films of Film 1 (from Table 2), with seal layers facing each other.

Each fitment-film configuration is subjected to a heat sealing process utilizing opposing seal bars with concave surfaces between flat front surface and flat recessed surface as set forth in co-pending application U.S. Ser. No. 15/276,014 filed on Sep. 26, 2016 with conditions below.

TABLE 4

Processing Conditions for Installing the Fitments
Concave Seal bar process conditions Equipment: Sommer Automatic Sealer GP 260
Description: Opposing seal bars with concave curved surface and independent temperature control and force distribution.

| | |
|---|---|
| Seal pressure | 1-2 MPa |
| 1st Seal bar temperature: | 194° C. |
| 2nd Seal bar temperature: | 194° C. |
| Seal time: | 1.2 seconds |

The heat sealing procedure produces flexible containers that are stand-up pouches (SUPs) as shown in FIGS. 1-5.

4. Leak Test

The Lippke test evaluates additional seal integrity for the SUPs. The Lippke test perforates the flexible container with a needle and air pressurized to 150 mbar according to the conditions as described in Table 5 below. After 60 seconds, the pressure gap is registered. If the flexible container has no failure, the pressure will remain the same. The flexible container sample is submerged into a water tank so that air bubbles can be observed coming out of fissure or failure where it exists. The Lippke test determines whether the failure comes from the triple sealing point or from different sources such as poor fitment-closure junction.

Leak test for the flexible containers is performed under the following parameters.

TABLE 5

Lippke Test Procedure

| Analysis | Analysis Description | |
|---|---|---|
| Leak Test | Leak test using Lippke 4500 | |
| Equipment condition (Lippke 4500) | | |
| Parameter | Value | Unit |
| Test pressure | 150 | mbar |
| Setting time | 10 | sec |
| Test time | 60 | sec |
| Limit | 50 | mbar |
| Package Volume [ml] 200 | 200 | ml |

The flexible container is subjected to an internal pressure of 150 mbar. The test entails waiting 60 seconds for settling. The pressure drop is measured for 60 seconds. The flexible container is then submerged in water and the spout/cap junction is observed to monitor whether bubble formation occurs. Higher values of pressure drop indicate a higher leak in the package.

TABLE 6

Lippke Test Results of SUPs

| Sample | Pressure drop after 60 sec (mbar) | Note |
|---|---|---|
| CS 1 | 20.6 | High leak in the spout/cap junction |
| CS 2 | 146.7 | Complete leak in the spout/cap |
| CS 3 | 46.9 | High leak in the spout/cap junction |
| CS 4 | 46.1 | High leak in the spout/cap junction |
| CS 5 | 60.1 | High leak in the spout/cap junction |
| CS 6 | 9.1 | High leak in the spout/cap junction |
| CS 7 | 146.6 | Complete leak in the spout/cap |
| CS 8 | 18.6 | High leak in the spout/cap junction |
| CS 9 | 64.2 | High leak in the spout/cap junction |
| IE 1 | 4.6 | No visual leak in the spout/cap junction |
| IE 2 | 4.6 | No visual leak in the spout/cap junction |
| IE 3 | 5.5 | No visual leak in the spout/cap junction |
| IE 4 | 4.6 | No visual leak in the spout/cap junction |

Test pressure is 150 mbar for all samples in Table 6.

Table 6 shows that fitments made with the present polymeric blend of 60-90 wt % ethylene/α-olefin multi-block copolymer and (ethylene/octene multi-block copolymer in particular) and 40-10 wt % HDPE exhibit less deformation during the heat sealing process and also exhibit improved recoil and post-heat seal recovery compared to fitments composed of 100 wt % ethylene/α-olefin multi-block copolymer.

The present fitments made with the polymeric blend of ethylene/α-olefin multi-block copolymer-and-HDPE recover to a fuller degree (post-heat seal) compared to fitments made with 100 wt % ethylene/α-olefin multi-block copolymer. The present fitment recovers to a circular, or a substantially circular, cross-sectional shape post-heat sealing. The circular cross-sectional post-seal shape of the present fitment yields a better fitment-to-closure seal as demonstrated by lower Lippke test pressure drops when compared to fitments made from 100 wt % ethylene/α-olefin multi-block copolymer.

It is specifically intended that the present disclosure not be limited to the embodiments and illustrations contained herein, but include modified forms of those embodiments including portions of the embodiments and combinations of elements of different embodiments as come within the scope of the following claims.

The invention claimed is:

1. A flexible container comprising:

a first multilayer film and a second multilayer film, each multilayer film comprising a seal layer, the seal layer composed of an olefin-based polymer, the multilayer films arranged such that the seal layers oppose each other and the second multilayer film is superimposed on the first multilayer film, the films sealed along a common peripheral edge;

a fitment comprising a base, the base comprising a polymeric blend of from 60 wt % to 90 wt % ethylene/α-olefin-multi-block copolymer and from 40 wt % to 10 wt % high density polyethylene (HDPE), the polymeric blend having an elastic recovery from 50% to 90% as measured in accordance with ASTM D 1708;

in situ formed winglets, extending from opposing sides of the base, the winglets composed of the ethylene/α-olefin-multi-block copolymer, the HDPE, and the seal layer olefin-based polymer;

a fitment seal comprising the base located between the multilayer films and the base is sealed to each multilayer film at a portion of the common peripheral edge; and the flexible container exhibits a pressure drop of less than 6 mbar as measured in accordance with the Lippke test.

2. The flexible container of claim 1 wherein the HDPE has a density from 0.955 g/cc to 0.965 g/cc.

3. The flexible container of claim 2 wherein the HDPE has a melt index from 1.0 g/10 min to 3.0 g/10 min.

4. The flexible container of claim 3 wherein the HDPE is a bimodal HDPE.

5. The flexible container of claim 1 wherein the base has a wall thickness from 0.3 mm to 2.0 mm.

6. The flexible container of claim 1 wherein the polymeric blend has a Shore A hardness from 80 to 100.

7. The flexible container of claim 1 wherein the polymeric blend has an elongation at break from 180% to 410%.

8. The flexible container of claim 1 wherein the polymeric blend has a tensile modulus from 50 MPa to 275 MPa.

9. The flexible container of claim 1 wherein the seal layer is composed of an ethylene-based polymer.

10. The flexible container of claim 1 wherein the fitment comprises a top extending from the base, the base and the top are composed of the polymeric blend.

11. The flexible container of claim 10 wherein the flexible container is a stand-up pouch.

12. The flexible container of claim 1 comprising a closure secured to the fitment.

* * * * *